US007627087B2

(12) United States Patent
Zou et al.

(10) Patent No.: US 7,627,087 B2
(45) Date of Patent: Dec. 1, 2009

(54) ONE-DIMENSIONAL GRID MESH FOR A HIGH-COMPRESSION ELECTRON GUN

(75) Inventors: Yun Zou, Clifton Park, NY (US); Mark E. Vermilyea, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 25 days.

(21) Appl. No.: 11/770,331

(22) Filed: Jun. 28, 2007

(65) Prior Publication Data

US 2009/0003529 A1 Jan. 1, 2009

(51) Int. Cl.
*H01J 35/14* (2006.01)

(52) U.S. Cl. ..... 378/122; 378/138

(58) Field of Classification Search ..... 378/122, 378/136, 138, 119

See application file for complete search history.

(56) References Cited

U.S. PATENT DOCUMENTS 4,521,901 A 6/1985 Rand
5,907,595 A * 5/1999 Sommerer ..... 378/136
6,553,096 B1 * 4/2003 Zhou et al. ..... 378/122
2005/0175151 A1 8/2005 Dunham et al.
2006/0274889 A1 * 12/2006 Lu et al. ..... 378/122
2008/0084152 A1 * 4/2008 Dijon et al. ..... 313/309

* cited by examiner

*Primary Examiner*—Hoon Song
(74) *Attorney, Agent, or Firm*—Jason K. Klindtworth

(57) ABSTRACT

A field emitter electron gun includes at least one field emitter cathode deposited on a substrate layer and configured to generate an electron beam. An extraction plate having an opening therethrough is positioned adjacent to the at least one field emitter cathode and is operated at a voltage so as to extract the electron beam out therefrom. A meshed grid is disposed between each of the at least one field emitter cathodes and the extraction plate. The meshed grid is configured to operate at a voltage so as to enhance an electric field at a surface of the at least one field emitter cathode. The meshed grid is a one-dimensional grid configured to focus the electron beam received from the at least one field emitter cathode into a desired spot size.

18 Claims, 6 Drawing Sheets

FIG. 4
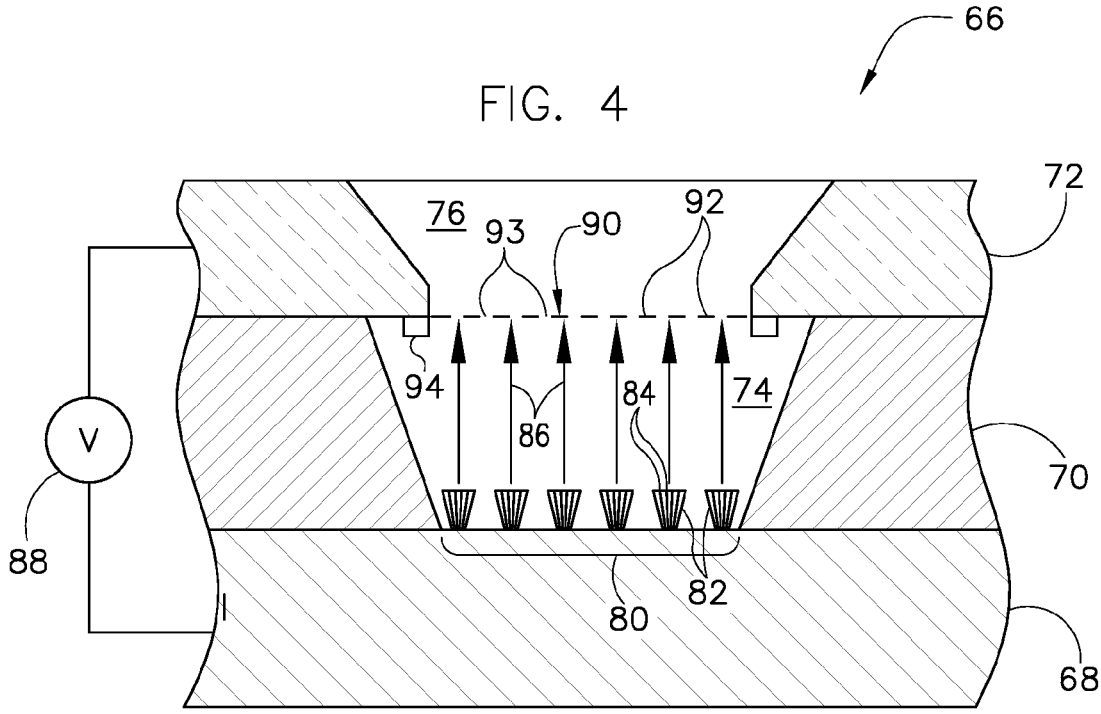
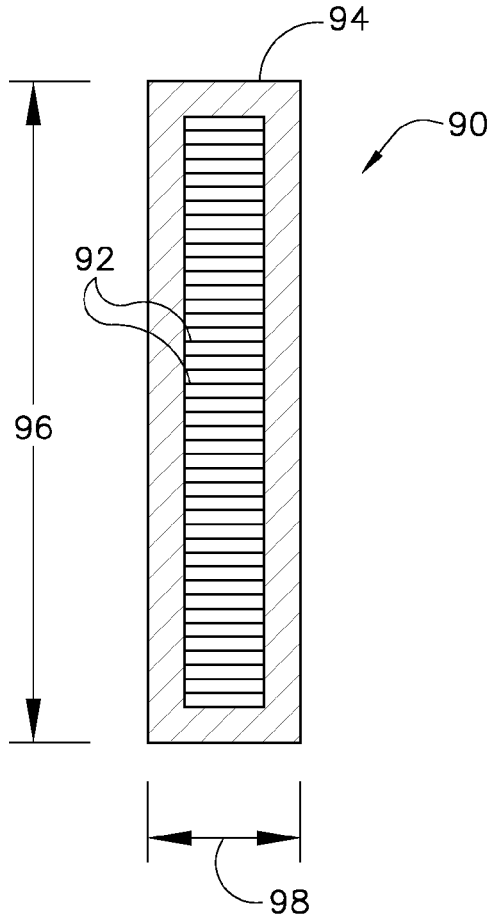
FIG. 5

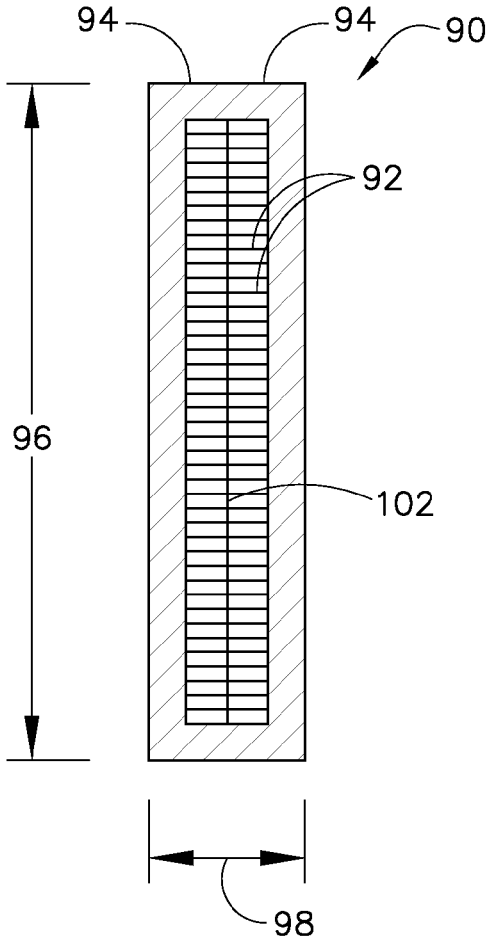
FIG. 7
FIG. 8
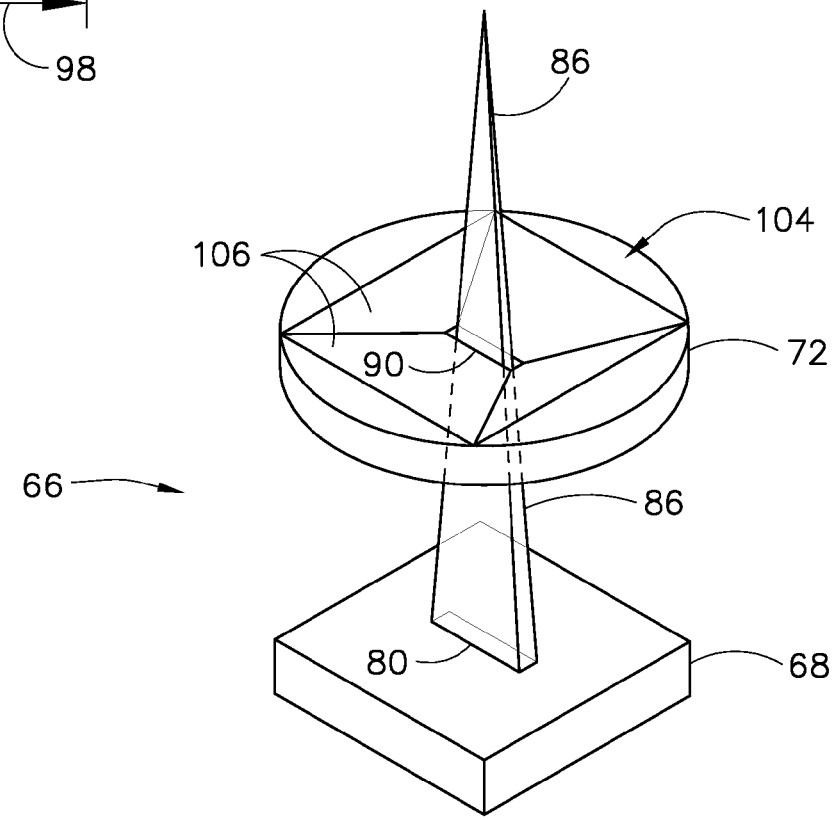

ONE-DIMENSIONAL GRID MESH FOR A HIGH-COMPRESSION ELECTRON GUN

BACKGROUND OF THE INVENTION

The present invention relates generally to an electron optics scheme for generation of high frequency electromagnetic energy and, more particularly, to a method and apparatus for extracting an electron beam from a cathode while preserving beam quality.

X-ray generating systems typically include an electron generating cathode and an anode in a sealed housing. The cathode provides an electron stream or current that is directed toward the anode. This focused electron beam is accelerated across the anode-to-cathode vacuum gap and produces x-rays upon impact with the anode. Because of the high power density generated at the location where the electron beam strikes the target, it is desirable to rotate the anode assembly. Many x-ray tubes therefore include a rotating anode structure for distributing the heat generated at a focal spot. The anode is typically rotated by an induction motor having a cylindrical rotor built into a cantilevered axle. The axle supports a disc-shaped anode target as well as an iron stator structure with copper windings that surrounds an elongated neck of the x-ray tube. The rotor of the rotating anode assembly is driven by the stator. The whole cathode and anode assembly is enclosed in a high vacuum environment.

One particular use of such x-ray generators is in the field of diagnostic imaging. Typically, in computed tomography (CT) imaging systems, for example, an x-ray source is collimated to emit a fan-shaped beam toward a subject or object, such as a patient or a piece of luggage. The beam, after being attenuated by the subject, impinges upon an array of radiation detectors. The intensity of the attenuated beam radiation received at the detector array is typically dependent upon the attenuation of the x-ray beam by the subject. Each detector element of the detector array produces a separate electrical signal indicative of the attenuated beam received by each detector element. The electrical signals are transmitted to a data processing system for analysis which ultimately produces an image.

Generally, the x-ray tube or generator and the detector array are rotated about the gantry within an imaging plane and around the subject. X-ray detectors typically include a post-patient collimator for collimating x-ray beams received at the detector, a scintillator for converting x-rays to light energy adjacent the collimator, and photodiodes for receiving the light energy from the adjacent scintillator and producing electrical signals therefrom. Typically, each scintillator of a scintillator array converts x-rays to light energy. Each scintillator discharges light energy to a photodiode adjacent thereto. Each photodiode detects the light energy and generates a corresponding electrical signal. The outputs of the photodiodes are then transmitted to the data processing system for image reconstruction.

In order to generate an x-ray beam of sufficient strength for CT and other x-ray based diagnostic imaging modalities, cathode assemblies of x-ray tubes often provide close to 1 ampere of electron current. The electrons emitted from a cathode are accelerated across the vacuum gap of the x-ray tube to the anode by voltages on the order of 20 to 150 kVp. To achieve electron emission from a thermionic emitter, for example, a control voltage of about 10 V is applied across the tungsten filament, producing high temperatures and a current of about 7 amps in the filament. Therefore, adjustments to the cathode control voltage and/or current regulate the tube current.

The high voltage vacuum environment within many x-ray tubes presents additional considerations for cathode design. Some attempts to reduce the power demands of an x-ray tube cathode have utilized specially designed materials having lower work functions than ordinary thermionic filaments. Others have sought to incorporate field emitter (FE) arrays into cathode assemblies; however, in order to implement such a FE array into a cathode assembly, several issues have to be addressed. First, in order to extract the electron beam from the FE cathode, a certain electric field must be applied on the cathode. To minimize the voltage necessary for extraction of the electron beam from the cathode, a mesh grid is often used to enhance the field strength at the surface of the field emitter. Another consideration in the design of the FE array is the efficiency with which focusing of the electron beam is carried out so as to form a usable focal spot on a target. Certain beam optics must be designed to focus the electron beam into a desirable spot size. While traditional mesh grids provide efficient low voltage extraction of the electron beam from the FE cathode, the grids also can cause degradation in the beam quality and negatively impact formation of a usable focal spot. That is, the increased beam emittance of the electron beam after the beam hits the mesh grid prevents the beam from being focused to a small spot on the target. Thus, it is difficult to design a FE cathode having a highly compressed electron beam when utilizing such a mesh grid.

Therefore, it would be desirable to have an apparatus and method for minimizing the voltage necessary for extraction of the electron beam from the cathode, while still allowing for sufficient focusing of the electron beam so as to form a usable focal spot on a target. In particular, it would be desirable to have a mesh grid that allows for efficient low voltage extraction and beam focusing.

BRIEF DESCRIPTION OF THE INVENTION

The present invention overcomes the aforementioned drawbacks by providing a cathode assembly that provides low voltage extraction and improved beam focusing. The cathode assembly includes a field emitter cathode and a one-dimensional mesh grid that function to minimize degradation of the electron beam and allow for focusing of the electron beam into a desired spot size.

According to one aspect of the present invention, a field emitter electron gun includes at least one field emitter cathode deposited on a substrate layer and configured to generate an electron beam and an extraction plate having an opening therethrough positioned adjacent to the at least one field emitter cathode and operated at a voltage so as to extract the electron beam out therefrom. The field emitter electron gun also includes a meshed grid disposed between each of the at least one field emitter cathodes and the extraction plate, the meshed grid configured to operate at a voltage so as to enhance an electric field at a surface of the at least one field emitter cathode, wherein the meshed grid is a one-dimensional grid configured to focus the electron beam received from the at least one field emitter cathode into a desired spot size.

According to another aspect of the present invention, an x-ray tube for an imaging system includes a housing enclosing a vacuum-sealed chamber therein, a target generally located at a first end of the chamber and configured to produce x-rays when impinged by a plurality of electron beams, and a field emitter array generally located at a second end of the chamber to generate the plurality of electron beams and transmit the electron beams toward the target, the field emitter array including a plurality of field emitter units therein. Each of the plurality of field emitter units further includes a substrate, an emitter element positioned on the substrate and configured to generate an electron beam, an extracting electrode positioned adjacent to the emitter element to extract the electron beam out therefrom, and a metallic grid disposed between the emitter element and the extraction element to enhance an electric field at a surface of the emitter element, the metallic grid comprising a plurality of parallelly aligned wires spaced apart a desired distance to form a one-dimensional grid.

According to yet another aspect of the present invention, a cathode assembly for an x-ray source includes a substrate layer, an extraction element having an opening therein and a surface having two angular cuttings thereon, and a dielectric element between the substrate and the extraction element, the dielectric element having a cavity therein. The cathode assembly also includes a field emitter element disposed in the cavity of the dielectric element and configured to emit a stream of electrons when an emission voltage is applied across the extraction element and a one-directional grid connected to the extraction element to lower the emission voltage supplied to the extraction element.

Various other features and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings:

FIG. 4 is a cross-sectional view of a field emitter unit/cathode assembly in accordance with an embodiment of the present invention.

FIG. 5 is a top view of a mesh grid in accordance with an embodiment of the present invention.

FIG. 7 is a top view of a mesh grid in accordance with another embodiment of the present invention.

FIG. 8 is an exploded perspective view of the field emitter unit/cathode assembly shown in FIG. 3.

DETAILED DESCRIPTION OF THE INVENTION

The operating environment of the present invention is described with respect to a sixty-four-slice computed tomography (CT) system. While described with respect to a "third generation" CT scanner, the present invention is equally applicable with other CT systems. Additionally, it will be appreciated by those skilled in the art that the present invention is equally applicable for use with other applications in which an electron gun is implemented.

Figure 1:
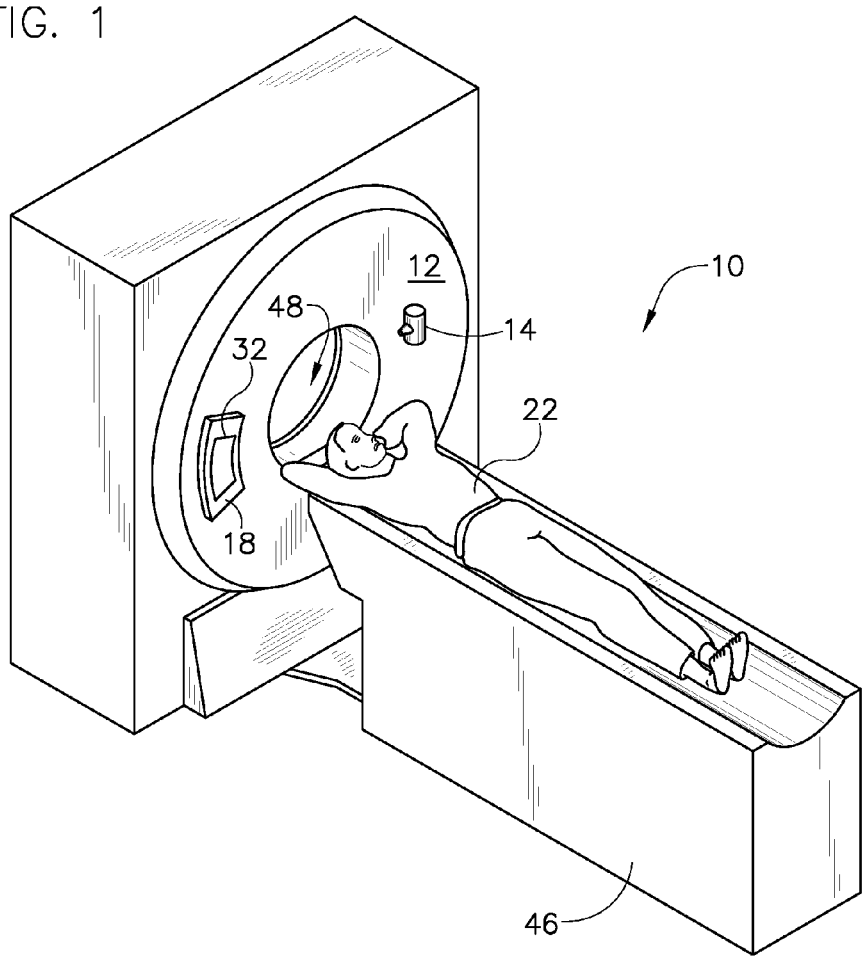
FIG. 1 is a pictorial view of a CT imaging system incorporating an embodiment of the present invention.
Figure 2:
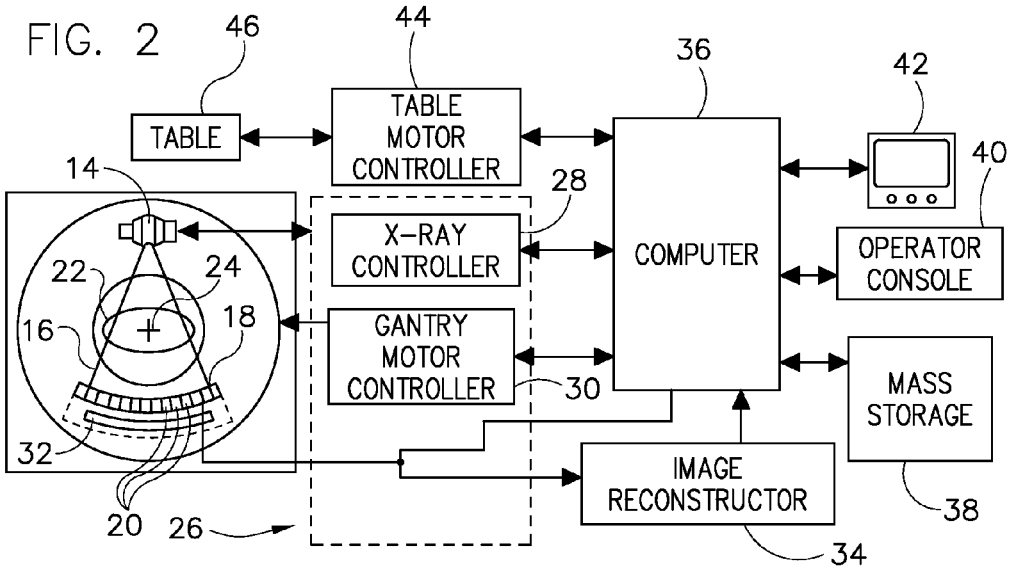
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray source 14 that projects a beam of x-rays 16 toward a detector assembly or collimator 18 on the opposite side of the gantry 12. Referring now to FIG. 2, detector assembly 18 is formed by a plurality of detectors 20 and data acquisition systems (DAS) 32. The plurality of detectors 20 sense the projected x-rays that pass through a medical patient 22, and DAS 32 converts the data to digital signals for subsequent processing. Each detector 20 produces an analog electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 and gantry 12. Particularly, table 46 moves patients 22 through a gantry opening 48 of FIG. 1 in whole or in part.

Figure 3:
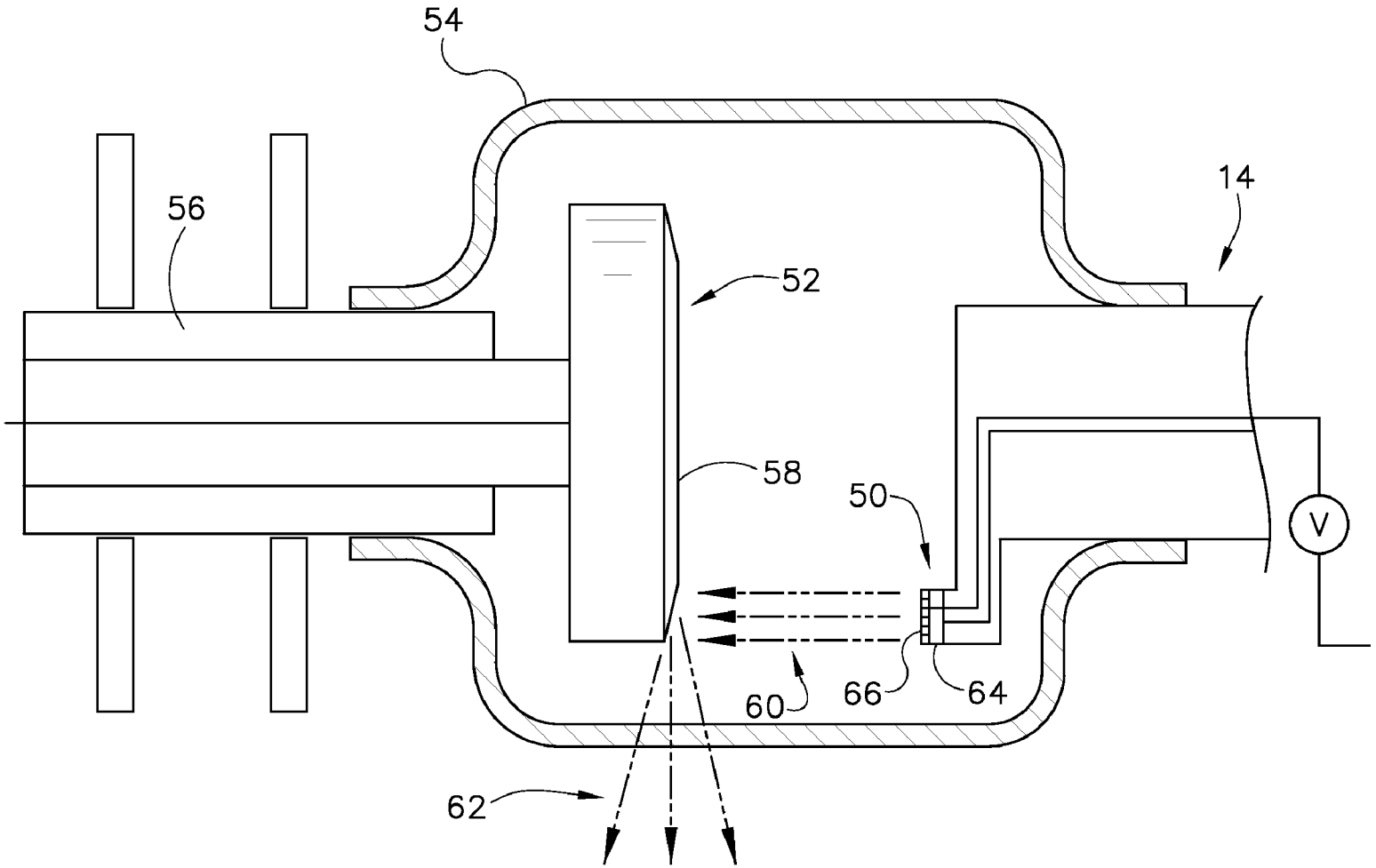
FIG. 3 is a schematic view of an x-ray source in accordance with an embodiment of the present invention.

Referring now to FIG. 3, x-ray source 14 included in CT system 10 is shown in detail. The x-ray source 14 comprises an x-ray generating tube 14, which principally includes a field emitter-based electron gun 50 and an anode assembly 52 encased in a housing 54. Anode assembly 52 includes a rotor 56 configured to turn a rotating anode disc 58 (i.e., target), as is known in the art. When struck by an electron current 60 from electron gun 50, anode 58 emits an x-ray beam 62 therefrom. In a preferred embodiment, electron gun 50 comprises a field emitter electron gun having an electron source in the form of an array 64 of field emitter (FE) units 66 (i.e., cathode assemblies).

Referring to FIG. 4, a cross-sectional view of a single FE unit 66 from the field emitter array 64 (shown in FIG. 3) is shown. Preferably, in one embodiment, FE unit 66 is a carbon nanotube (CNT) type field emitter, though it is understood that the features and adaptations described herein are also applicable to other types of field emitters. In the embodiment shown, a substrate layer 68 forms a base of the FE unit 66. Substrate layer 68 may be formed of a conductive or semi-conductive substance, such as silicon- or metal-based substances. An insulating or dielectric layer 70 is formed or deposited over substrate layer 68 by any of several known chemical or etching manufacturing processes. Dielectric layer 70 may be a non-conductive substance or a substance of a very high electrical resistance, such as silicon dioxide ($SiO_2$) or silicon nitrate (SiN). Dielectric layer 70 is used to separate the substrate layer 68 from an extraction element 72 (i.e., extraction plate, extraction electrode), so that an electrical potential may be applied between extraction element 72 and substrate 68.

A channel or cavity 74 is formed in dielectric layer 70, and a corresponding opening 76 is formed in extraction element 72. As shown, opening 76 substantially overlaps cavity 74. In other embodiments, cavity 74 and opening 76 may be of approximately the same diameter, or cavity 74 may be narrower than opening 76 of extraction element 72. Therefore, in manufacture, cavity 74 may be created in dielectric layer 70 before extraction element 72 is placed thereon.

A field emitter cathode 80 (i.e., field emitter element) is disposed in cavity 74, affixed on substrate layer 68. As shown, FE cathode 80 is comprised of a plurality of macro-emitters 82, with each macro-emitter 82 formed from a group of carbon nanotubes (CNTs) 84. The groups of CNTs 84 are aligned with opening 76 to facilitate the interaction of an electrical field of opening 76 with the FE cathode 80, for ease of electron emission. Thus, when a control voltage is applied thereto, FE cathode 80 generates an electron stream 86 therefrom, which may be used for a variety of functions.

In operation of the FE unit 66, a control voltage is applied across extraction element 72 and substrate 68 by way of a voltage source 88 to create a strong electric field near opening 76. The electric field caused by the applied voltage induces an electron stream 86 to be emitted from FE cathode 80. The electron stream 86 is accelerated across cavity 74 by the difference in electrical potential. In this regard, cavity 74 is preferably a vacuum gap. In order to lower the voltage needed to extract the electron beam 86 from FE cathode 80, a wire mesh grid 90 is disposed between the extraction element 72 and the FE cathode 80. Mesh grid 90 is connected to and held in place by extraction plate 72 and extends across opening 76 at a desired distance from FE cathode 80 to enhance the electric field at the FE cathode 80 surface, but with a much reduced total extracting voltage. This improves the high voltage stability of the cathode assembly 66, therefore inherently making it possible to achieve higher emission current in the electron beam 86.

The mesh grid 90 is comprised of a plurality of wires 92 positioned within a support structure 94. The plurality of wires 92 are spaced apart a desired distance from one another to form a plurality of openings 93 in the mesh grid 90 through which electrons in the electron beam 86 are transmitted. The plurality of wires 92 that form the mesh grid 90, however, also intercept beam current from the electron beam 86, which causes degradation in the beam quality and negatively impacts formation of a usable focal spot on anode 58 (shown in FIG. 3). That is, the increased beam emittance of the electron beam 86 after the beam hits the mesh grid 90 prevents the beam from being focused to a small spot on the anode.

In one embodiment, the amount of beam current intercepted by the mesh grid 90 can be reduced, and degradation in the beam quality minimized, by aligning the multiple macro-emitters 82 with openings 93 in the mesh grid 90. In this case, a substantially higher percentage of electrons will pass through the grid 90.

Referring now to FIG. 5, mesh grid 90 is shown from a top plan view. To further reduce the amount of beam current intercepted by the grid 90 (which can be at the percentage rate of around 10% to 40% with a traditional mesh grid) the mesh grid 90 is constructed as a one dimensional grid. That is, wires 92 used to form mesh grid 90 are aligned directionally parallel in a single direction. The width of each of the plurality of wires 92 and the spacing between the wires can vary, but in one embodiment, the wire width is 0.05 mm and the spacing between each of the wires is 0.38 mm. As shown in FIG. 5, mesh grid 90 is formed as a non-circular grid having a high aspect ratio of length 96 to width 98. For example, the grid 90 could have an aspect ration of 2×8 mm, such that the width is 2 mm and the length is 8 mm. The parallelly aligned wires 92 are positioned such that they run across the width 98 of the high aspect ratio mesh grid 90. The one-dimensional arrangement of the wires 92 allows for a greater percentage of beam current to pass through mesh grid 90 without being intercepted and provides for minimum degradation of the electron beam 86 (shown in FIG. 4) in a direction parallel to the plurality of wires. That is, one-dimensional grid 90 allows for compression of the electron beam in the direction parallel to the plurality of wires 92 and focusing of the electron beam into a desired spot size.

Figure 6A:
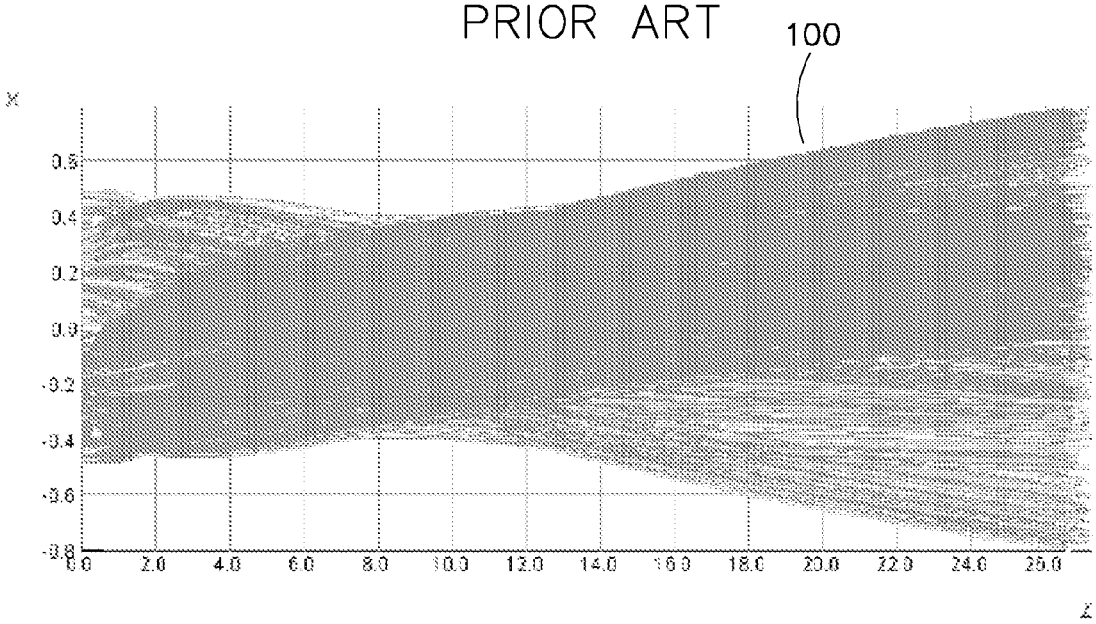
FIG. 6A PRIOR ART
FIG. 6A is a graphical representation of electron beam focusing as provided in the prior art.
Figure 6B:
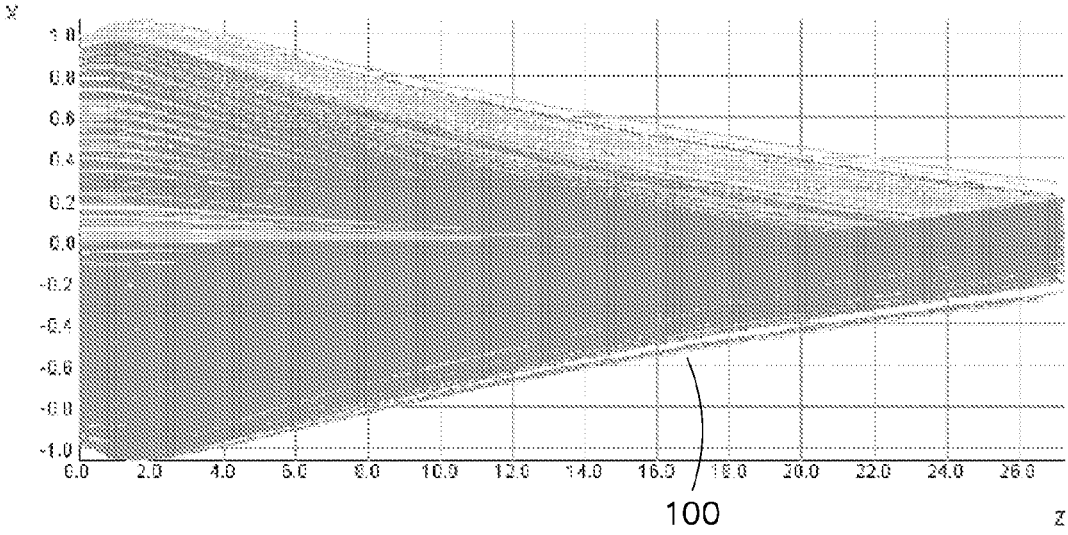
FIG. 6B is a graphical representation of electron beam focusing in accordance with the present invention.

The improvement in quality of the electron beam can be seen in FIGS. 6A and 6B. That is, FIG. 6A shows a trajectory/profile of an electron beam 100 upon passing through a two-dimensional grid, as is known in the prior art. With a two-dimensional grid, the electron beam 100 cannot be compressed in any one direction. The beam trajectory is split into multiple directions because of the two-dimensional grid. FIG. 6B shows a profile of an electron beam 100 upon passing through a one-dimensional grid. As stated above, the one-dimensional grid allows for compression of the electron beam 100 in one direction, the x-direction. As such, degradation of the electron beam 100 in a direction parallel to the plurality of wires is minimized and this allows for focusing of the electron beam 100 into a desired spot size.

As shown in FIG. 7, in another embodiment, the mesh grid 90 can include one or more cross-wires 102 (i.e., support wires) that are oriented perpendicularly to the plurality of parallelly positioned wires 92. The one or more cross-wires 102 run the length 96 of the high aspect ratio mesh grid 90 and function to provide and improve the mechanical strength and thermal stability of the grid. While the number of cross-wires 102 can vary, the greater the number of cross-wires, the more the beam quality will be compromised. A trade-off between mechanical strength and beam quality can be examined when selecting the number of cross-wires 102 to implement into the one-dimensional mesh grid 90.

Referring now to FIG. 8, an exploded perspective view of the FE unit 66 is shown. As shown therein, FE cathode 80 is formed as a non-circular field emitter cathode having a high aspect ratio of length to width. As such, non-circular FE cathode 80 is configured to match-up with the non-circular, one-dimensional mesh grid 90 in the opening of extraction element 72. The high aspect ration FE cathode 80 emits a line focus electron beam 86 that corresponds to its length and width. The beam optics design provided by the one-dimensional grid 90 compresses the line focus beam 86 only in one direction (the direction parallel to the plurality of wires) and leaves the beam size in the other direction unchanged; however as shown in the graph of FIG. 6B, beam quality need only be preserved in one direction, not the other direction, in order to focus the electron beam received from the FE cathode into a desired spot size. Thus, one directional mesh grid 90 allows for focusing of the electron beam 86, while at the same time, still providing enough field enhancements on the surface of the FE cathode 80 to minimize extraction voltage.

FIG. 8 also shows that extracting element 72 includes a face 104 having a plurality of angled surfaces 106 thereon formed by angular cuttings. The pair of angled surfaces 106 on face 104 are positioned toward anode 58 (shown in FIG. 3). The pair of angular surfaces 106 function to focus the electron beam 86 differently in two directions. Thus, the angular surfaces 106 work with the one-dimensional grid 90 to provide focusing of the electron beam 86 as desired by an operator.

Figure 9:
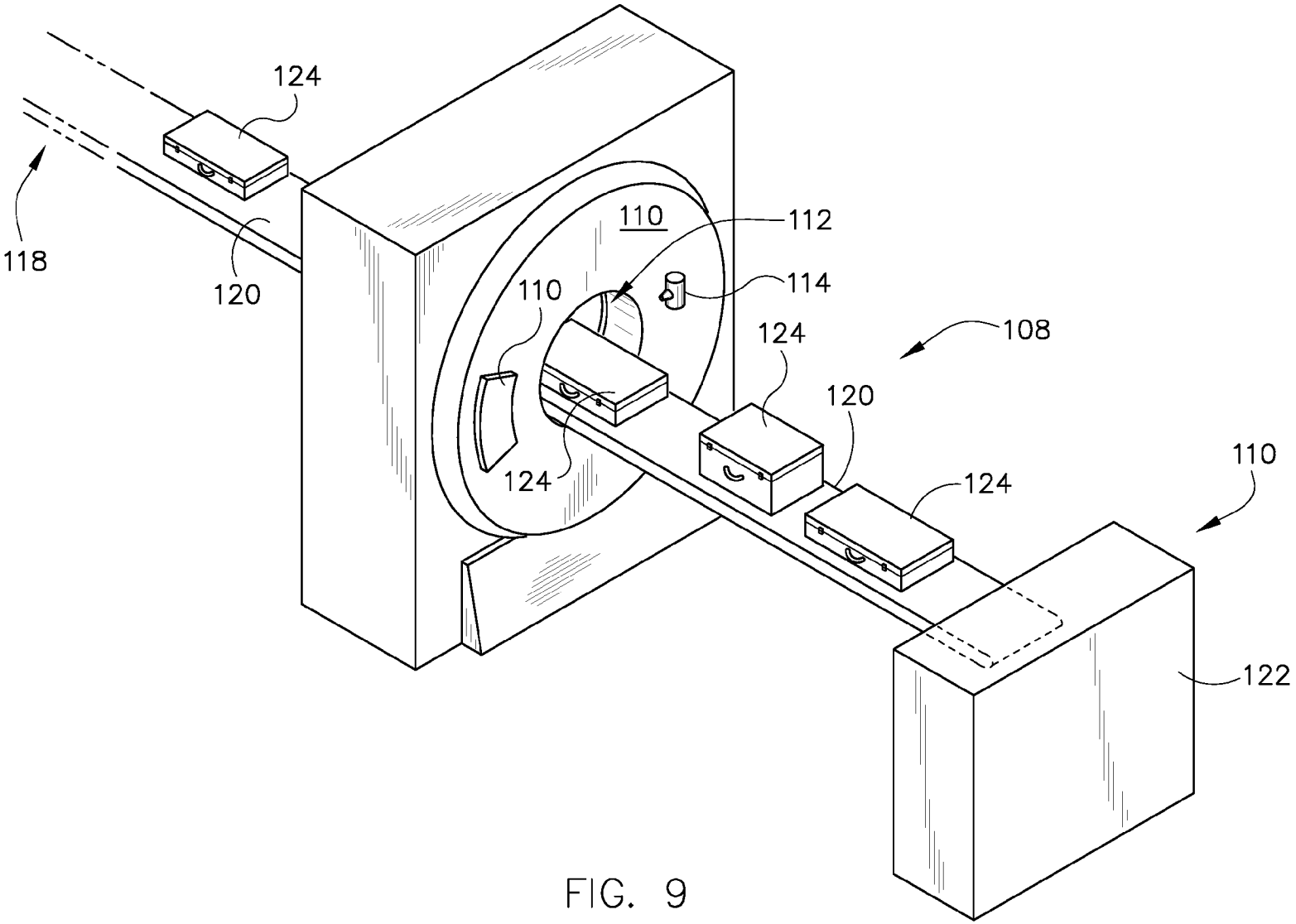
FIG. 9 is a pictorial view of a CT system for use with a non-invasive package inspection system.

FIG. 9 depicts another implementation of the present invention. A package/baggage inspection system 108 includes a rotatable gantry 110 having an opening 112 therein through which packages or pieces of baggage may pass. The rotatable gantry 110 houses a high frequency electromagnetic energy source 114 as well as a detector assembly 116. The high frequency electromagnetic energy source 114 is configured to utilize secondary electron emission in generating high frequency electromagnetic energy beams, in accordance with the aspects and embodiments of the present invention discussed above. A conveyor system 118 is also provided and includes a conveyor belt 120 supported by structure 122 to automatically and continuously pass packages or baggage pieces 124 through opening 112 to be scanned. Objects 124 are fed through opening 1112 by conveyor belt 120, imaging data is then acquired, and the conveyor belt 120 removes the packages 124 from opening 112 in a controlled and continuous manner. As a result, postal inspectors, baggage handlers, and other security personnel may non-invasively inspect the contents of packages 124 for explosives, knives, guns, contraband, etc.

Other embodiments besides those set forth above are also envisioned as implementing an electron gun having a FE unit with a one-dimensional grid therein that allows for efficient low voltage extraction and beam focusing. For example, the electron gun can be used as part of in a multiple spot x-ray source, in which a high aspect ratio FE cathode is desired. Additionally, the one-dimensional grid structure set forth above can be used not only for CNT field emitters, but also with a traditional filament thermionic cathode, a ferro-electric emitter, or a layer of some substance having a low work function or high NEA could be substituted for or used in combination with CNT emitters. Alternatively, inorganic or metallic nanowires could also be utilized in place of, or in conjunction with CNTs.

Therefore, according to one embodiment of the present invention, a field emitter electron gun includes at least one field emitter cathode deposited on a substrate layer and configured to generate an electron beam and an extraction plate having an opening therethrough positioned adjacent to the at least one field emitter cathode and operated at a voltage so as to extract the electron beam out therefrom. The field emitter electron gun also includes a meshed grid disposed between each of the at least one field emitter cathodes and the extraction plate, the meshed grid configured to operate at a voltage so as to enhance an electric field at a surface of the at least one field emitter cathode, wherein the meshed grid is a one-dimensional grid configured to focus the electron beam received from the at least one field emitter cathode into a desired spot size.

According to another embodiment of the present invention, an x-ray tube for an imaging system includes a housing enclosing a vacuum-sealed chamber therein, a target generally located at a first end of the chamber and configured to produce x-rays when impinged by a plurality of electron beams, and a field emitter array generally located at a second end of the chamber to generate the plurality of electron beams and transmit the electron beams toward the target, the field emitter array including a plurality of field emitter units therein. Each of the plurality of field emitter units further includes a substrate, an emitter element positioned on the substrate and configured to generate an electron beam, an extracting electrode positioned adjacent to the emitter element to extract the electron beam out therefrom, and a metallic grid disposed between the emitter element and the extraction element to enhance an electric field at a surface of the emitter element, the metallic grid comprising a plurality of parallelly aligned wires spaced apart a desired distance to form a one-dimensional grid.

According to yet another embodiment of the present invention, a cathode assembly for an x-ray source includes a substrate layer, an extraction element having an opening therein and a surface having two angular cuttings thereon, and a dielectric element between the substrate and the extraction element, the dielectric element having a cavity therein. The cathode assembly also includes a field emitter element disposed in the cavity of the dielectric element and configured to emit a stream of electrons when an emission voltage is applied across the extraction element and a one-directional grid connected to the extraction element to lower the emission voltage supplied to the extraction element.

The present invention has been described in terms of the preferred embodiment, and it is recognized that equivalents, alternatives, and modifications, aside from those expressly stated, are possible and within the scope of the appending claims.

What is claimed is:

1. A field emitter electron gun comprising:

at least one field emitter cathode deposited on a substrate layer and configured to generate an electron beam;

an extraction plate having an opening therethrough positioned adjacent to the at least one field emitter cathode and operated at a voltage so as to extract the electron beam out therefrom;

a meshed grid disposed between each of the at least one field emitter cathodes and the extraction plate, the meshed grid configured to operate at a voltage so as to enhance an electric field at a surface of the at least one field emitter cathode; and wherein the meshed grid is a non-circular one-dimensional grid comprising a plurality of parallelly aligned wires extending across the opening and configured to focus the electron beam received from the at least one field emitter cathode into a desired spot size.

2. The field emitter electron gun of claim 1 wherein the one-dimensional grid further comprises a plurality of wires positioned parallel to one another.

3. The field emitter electron gun of claim 2 wherein the one-dimensional grid is configured to have minimum beam degradation in a direction parallel to the plurality of wires.

4. The field emitter electron gun of claim 1 wherein the one-dimensional grid further comprises a plurality of openings therein to transmit electrons in the electron beam therethrough.

5. The field emitter electron gun of claim 4 wherein the field emitter cathode further comprises a plurality of macro-emitters aligned with the mesh grid openings.

6. The field emitter electron gun of claim 5 wherein each of the plurality of macro-emitters further comprises a carbon nanotube (CNT) group.

7. The field emitter electron gun of claim 1 wherein the extraction plate further comprises a face having a plurality of angular surfaces thereon to focus the electron beam, the face positioned toward an anode at which the electron beam is directed.

8. The field emitter electron gun of claim 1 wherein the field emitter cathode comprises a non-circular field emitter cathode having a high aspect ratio of length to width.

9. The field emitter electron gun of claim 1 further comprising a dielectric layer between the substrate layer and the extraction layer, the dielectric layer having a cavity therein.

10. An x-ray tube for an imaging system comprising:

a housing enclosing a vacuum-sealed chamber therein;

a target generally located at a first end of the chamber and configured to produce x-rays when impinged by a plurality of electron beams;

a field emitter array generally located at a second end of the chamber to generate the plurality of electron beams and transmit the electron beams toward the target, the field emitter array including a plurality of field emitter units therein; and wherein each of the plurality of field emitter units further comprises:

a substrate;

an emitter element positioned on the substrate and configured to generate an electron beam;

an extracting electrode positioned adjacent to the emitter element to extract the electron beam out therefrom;

a dielectric element between the substrate and the extracting electrode, the dielectric element having a cavity therein; and a non-circular metallic grid disposed between the emitter element and the extraction element and extending across the cavity to enhance an electric field at a surface of the emitter element, the metallic grid comprising a plurality of parallelly aligned wires spaced apart a desired distance to form a one-dimensional grid.

11. The x-ray tube of claim 10 wherein the one-dimensional grid is configured to minimize degradation of the electron beam quality in a direction parallel to the plurality of wires.

12. The x-ray tube of claim 10 wherein the emitter element further comprises a carbon nanotube field emitter.

13. The x-ray tube of claim 10 wherein the emitter element has a high aspect ratio of length to width and is configured to emit a line focus electron beam.

14. The x-ray tube of claim 10 wherein the housing is configured to be mountable to and rotate on a CT gantry.

15. The x-ray tube of claim 10 wherein the extracting electrode further comprises a surface having a pair of angular cuttings thereon facing the target.

16. A cathode assembly for an x-ray source comprising:

a substrate layer;

an extraction element having an opening therein and a surface having two angular cuttings thereon;

a dielectric element between the substrate and the extraction element, the dielectric element having a cavity therein;

a field emitter element disposed in the cavity of the dielectric element and configured to emit a stream of electrons when an emission voltage is applied across the extraction element; and a one-directional non-circular grid comprising a plurality of parallelly aligned wires extending across the cavity and connected to the extraction element to lower the emission voltage supplied to the extraction element.

17. The cathode assembly of claim 16 wherein the field-emitter element is a non-circular field emitter element having a high aspect ratio of length to width.

18. The cathode assembly of claim 16 wherein the field emitter element further comprises a carbon nanotube field emitter.

* * * * *